United States Patent [19]

Yang

[11] Patent Number: 4,936,184

[45] Date of Patent: Jun. 26, 1990

[54] MUSIC GENERATOR

[76] Inventor: Michael Yang, 4 Fl., No. 20-18, Tung Kwang Rd., Hsing Chu City, Taiwan

[21] Appl. No.: 343,341

[22] Filed: Apr. 26, 1989

[51] Int. Cl.[5] ..... G10H 7/10

[52] U.S. Cl. ..... 84/612

[58] Field of Search ..... 84/609, 610, 634, 649, 84/650, 666, 712, 611, 612, 651, 652, 713, 714

[56] References Cited

U.S. PATENT DOCUMENTS 4,328,731 5/1982 Gotho et al. ..... 84/609 X 4,690,025 9/1987 Hines et al. ..... 84/609 X

*Primary Examiner*—W. B. Perkey

*Attorney, Agent, or Firm*—Bacon & Thomas

[57] ABSTRACT

A music generator having a memory unit to store time and tone data of the selected song, which are read out successively from the memory unit in response to address signals applied to the memory unit by an address counter. The time data are sent to a latch, and the tone data are sent to a programmable counter and converted into a waveform by a wave shaping circuit. A tempo generator is electrically connected to, and actuates, a timing generator. The timing generator sends clock signals to the multiplexer when playing the selected song. Depending on the time data stored in the latch, the multiplexer determines and decides whether or not to actuate the address counter for requesting for the next tone data stored in the memory unit.

3 Claims, 8 Drawing Sheets

| 1 1 5 5 | 6 6 5 | 4 4 3 3 | 2 2 1 |

FIG. 3A

| 5 5 4·4 | 3 3 2 | 5 5 4 4 | 3 3 2 |

FIG. 3B

| TEMPO | | | |
|---|---|---|---|
| TIE | TONE1 | TONE2 | RYTHM |
| TIE | TONE1 | TONE2 | RYTHM |
| TIE | TONE1 | TONE2 | RYTHM |
| ⋮ | | | |

| |
|---|
| TEMPO |
| MAIN TIME |
| ACCOMPANYMENT TIME |
| TONE |
| TONE |
| ⋮ |
| MAIN TIME |
| ACCOMPANYMENT TIME |
| ⋮ |

FIG. 10

MUSIC GENERATOR

BACKGROUND OF THE INVENTION

The present invention relates to a music generator for generating a music which consists of at least a main melody, and more particularly relates to a method for storing the time and tone data of the music generator.

Heretofore, various hardware configurations for music generators have been developed in many parts of the world, but using an uneconomical method to store the tone and time data in the memory. As can be seen in FIG. 1, the conventional music generators comprise an oscillator 101, a tempo generator 102, two programmable counters 103 and 104, an address counter 105, a memory unit 106, a wave shaping circuit 107, an amplifier 108 and a transducer 109.

Time and tone data are stored in the memory unit 106, and control the tempo generator 102 and the programmable counters 103, 104. The tone data are stored in a plurality of bits in the memory unit 106 and are read out successively from each address in response to an address signal applied to the memory unit 106 by the address counter 105, which is controlled by the programmable counter 103 (i.e., the rhythm controller). The wave-shaping circuit converts the signals outputted from the programmable counter 104 and produces a waveform (for example, sinusoidal, rectangular or sawtoothed), and applies a selected modulating envelope to the outputted signal; for example, a decaying envelope. The shaped electronic signal wave form is amplified in the amplifier circuit 108 and the output of the amplifier 108 is converted to an acoustical output as a musical sound by the transducer 109.

The sequence (or method) for storing the time and tone data is illustrated in FIG. 2. Obviously, after storing the tempo data of a selected song, the time data are stored corresponding to respective tone data; i.e., taking each tone data with corresponding time data in the song as an unit. Each musical tone is controlled in its duration of the time data until the occurrence of the next musical tone in the same tone-producing circuit.

FIG. 3A shows a selected part of notes for a selected song. The data stored in the memory unit 106, wherein the eighth note is indicated by "0010" and the quarter note is indicated by "0001", are listed as follows:

| |
|---|
| Tempo data (for the selected song), |
| 0010 (time data), 0001 (tone data), 1 |
| 0010 (time data), 0001 (tone data), 1 |
| 0010 (time data), 0101 (tone data), 5 |
| 0010 (time data), 0101 (tone data), 5 |
| 0010 (time data), 0110 (tone data), 6 |
| 0010 (time data), 0110 (tone data), 6 |
| 0001 (time data), 0101 (tone data), 5 |
| and so on. |

The number of bits for data storage in the memory unit is "$14\times8=112$", in which the number of the notes is 14, and each note requires 8 bits to store the required data. Comprehensively, the memory space for storing the notes illustrated in FIG. 3B is equal to that for storing the notes in FIG. 3A, since the numbers of the notes therein are the same.

It should be noted that time data for duration of each musical tone data are read out of the memory unit 106 simultaneously with the tone data read-out which identifies the audio frequency of the musical note. The programmable counter 103 divides clock pulses supplied from the tempo generator 102. The division ratio of the programmable counter 103 is variable in response to the time or duration of the time data supplied from the memory unit 106.

A basic functional block diagram of another conventional music generator for dual tones is shown in FIG. 4, in which the technique involved therein is similar to that involved in the conventional music generator for a single tone. The block diagram of the conventional music generator for dual tones is similar to that of the music generator for single tone, but further provides a third programmable counter 104'. Similar to the programmable counter 104, the third programmable counter 104' is controlled by the memory unit 106 and is electrically connected to the wave shaping circuit 107. The programmable counters 104 and 104' respectively send signals to the wave shaping circuit 107 for the outputs of the main tones and the accompaniment tones.

The sequence (or method) for storing time and tone data is illustrated in FIG. 5. Obviously, after storing the tempo data of a selected song, a tie signal of two bits is stored and followed by respective main and accompaniment tone data of four bits, and the time data of four bits for the main and accompaniment tone data are then stored. It should be noted that the main tone is possibly accompanied by an accompaniment tone or two accompaniment tones. It is also possibly for there to be no accompaniment tone. The tie signal is provided to determine whether or not the main and accompaniment tones should be simultaneously played with regard to the time data. For example, as shown in FIG. 6, the third main tone in the second measure is accompanied by two accompaniment tones. In such a situation, the tie signal prevents the wave shaping circuit 107 from precharging the main tone when the accompaniment tone "Do" is played. Likewise, the first and second main tones in the fifth measure are only accompanied by an accompaniment tone, and the tie signal prevents the wave shaping circuit 107 not to precharging the accompaniment tone when the second main tone "So" is played.

The number of bits for data storage in the memory unit is "$(2+4+4+4)\times30=420$", in which the number of the tones is considered as 30, and each note requires 14 bits to store the required data.

The inconvenience in the above-mentioned method for storing the time and tone data is that when the adjacent tone data are the same, it is necessary to store the same time data, repeatedly. The present invention discloses another method for storing the rhythm and tone data to obviate the above-mentioned drawback.

SUMMARY OF THE INVENTION

A primary objective of the present invention is to provide a music generator which stores time and tone data in a manner that the tone of fastest time (i.e., value) in a selected song serves a standard unit to define an appropriate range; the time data for all the notes within the defined range are stored in an address and the tone data for each note therein are stored in a respective address.

Another objective of the present invention is to provide a method for storing the time and tone data in a music generator which can reduce the amount of memory space required for storing the selected song in comparison with that utilized in a conventional music generator.

These and additional objects, if not set forth specifically herein, will be readily apparent to those skilled in the art from the detailed description provided hereinafter, with appropriate reference to the accompanying drawings.

BRIEF DESCRIPTION OF THE DRAWINGS

FIGS. 3A and 3B are schematic diagrams listing numerical representations for the notes of a portion of a selected song;

FIG. 10 is a schematic diagram listing the data stored in the memory unit corresponding to the structure of FIG. 9.

DETAILED DESCRIPTION OF THE PREFERRED EMBODIMENT

Figure 7:
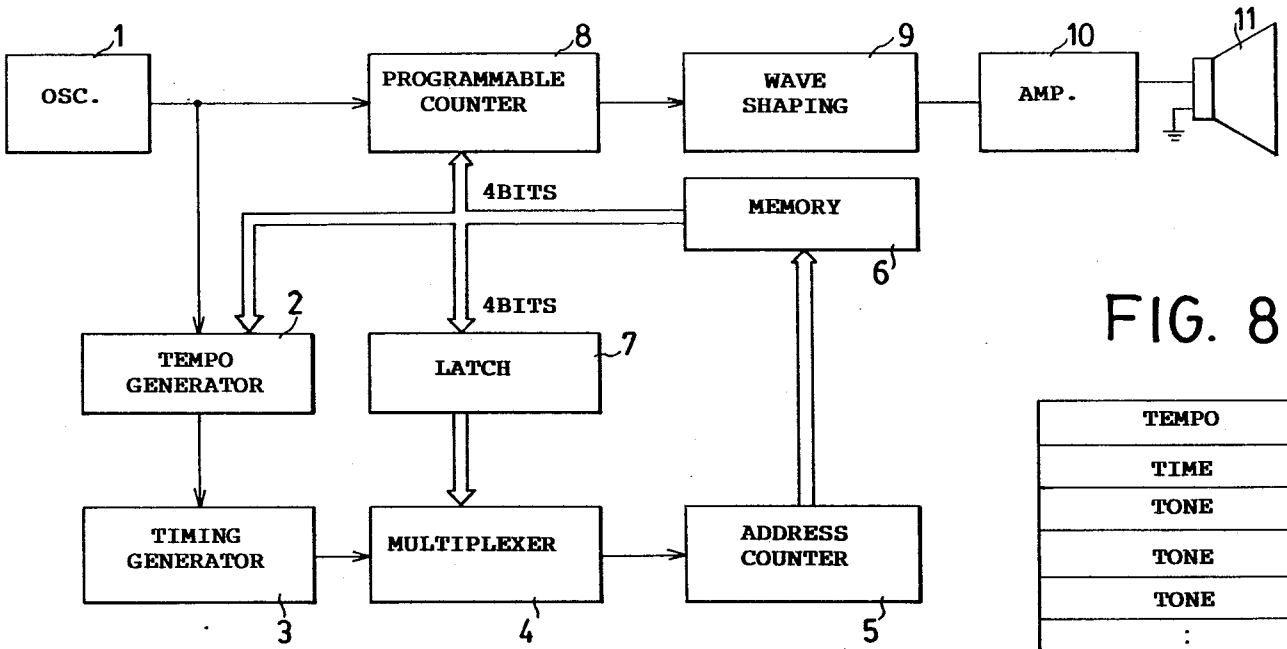
FIG. 7 is a functional block diagram of a music generator for a single-tone in accordance with the present invention.

Referring now to the drawings, and more particularly to FIG. 7 thereof, it can be seen that a music generator in accordance with the present invention comprises a tempo generator 2, a timing generator 3, a first multiplexer 4, an address counter 5, a memory unit 6, a latch 7, a first programmable counter 8, an oscillator actuating the tempo generator and the first programmable counter 8, a wave shaping circuit 9 connected to the first programmable counter 8, an amplifier 10 and a loudspeaker 11. As compared with the above-mentioned conventional music generator, the timing generator 3, the first multiplexer 4 and the latch 7 of this invention are not provided in the conventional music generator due to the difference in the method for storing the time and tone data between conventional music generators and this invention.

Unlike the method of storing the time and tone data corresponding to each tone in the conventional music generator, the memory unit 6 in the present invention stores a plurality of tone data and the time data comprising a plurality of bits for the music in a manner such that the duration of the note with the shortest time value serves as a time unit to define an appropriate range which is four times the duration of the time unit. For example, as shown in FIG. 3A, the time unit is the eighth note and the range is one measure; further, in FIG. 3B, the time unit is a sixteenth note and the range is a half measure. The time data for all the notes within the defined range are stored in an address, and the tone data for each note therein are stored in respective bits.

The tempo generator 2 enables the music to be played in a tempo according to a predetermined tempo data stored in the memory unit 6. The timing generator 3 is connected to and actuated by the tempo generator 2 and then sends clock signals to the first multiplexer 4. The time data and tone data are read out from the memory unit 6, in which the time data are sent to the latch 7, and the tone data are sent to the first programmable counter 8.

The latch 7 only selectively allows a bit of the time data of one state of high and low levels to pass through while stopping a bit of another state thereof. The first multiplexer 4 is responsive to the bit passing through the latch 7 to give a signal to the address counter 5 which in turn gives an address signal to the memory unit 6 to give the tone data to the first programmable counter 8. The tone data sent to the first programmable counter 8 are converted into a waveform by the wave shaping circuit 9 and are amplified by the amplifier 10.

Figure 8:
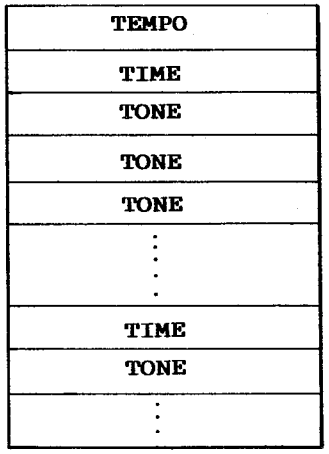
FIG. 8 is a schematic diagram listing the data stored in the memory unit corresponding to the structure of FIG. 7.

As can be seen in FIG. 8, the data stored in the memory unit 6 are listed for further description of this invention. It can be seen that, after storing a tempo data for the selected song, the time data for providing a timing of the sequence of consecutive notes in the range are stored and the tone data for each note are sequentially stored.

With respect to the song illustrated in FIG. 3A, the note with the shortest time value is eighth note and the range is one measure; for example, the data stored in the memory unit 6 are listed as follows:

| |
|---|
| Tempo data, |
| 1111 (time data for the first range), |
| 0001 (tone data), |
| 0001 (tone data), |
| 0101 (tone data), |
| 0101 (tone data), |
| 1110 (time data for the second range), |
| 0110 (tone data), |
| 0101 (tone data), |
| 0101 (tone data), and so on. |

The number of bits for data storage in the memory unit of this invention is "14×4+4×4=72", in which each note requires 4 bits to store the required tone data; the number of the ranges is 4, and each range requires 4 bits to store required data. It is obvious that the method of this invention reduces the required memory space to store data as compared with the conventional method in which the number of 112 bits is required to store the song.

With respect to the song illustrated in FIG. 3B in which the note with the time unit is sixteenth note and the range is a half measure, the data stored in the memory unit 6 are listed as follows:

| |
|---|
| Tempo data, |
| 1010 (time data), |
| 0101 (tone data), |
| 0101 (tone data), |
| 1001 (time data), |
| 0100 (tone data), |
| 0100 (tone data), |
| 1010 (time data), |

-continued

| |
|---|
| 0011 (tone data), and so on. |

The number of bits for data storage in the memory unit of this invention is "14×4+8×4=88", in which each note requires 4 bits to store the required tone data; the number of the ranges is 8, and each range requires 4 bits to store required data. Similarly, the method of this invention requires less memory space to store data than conventional methods.

Figure 9:
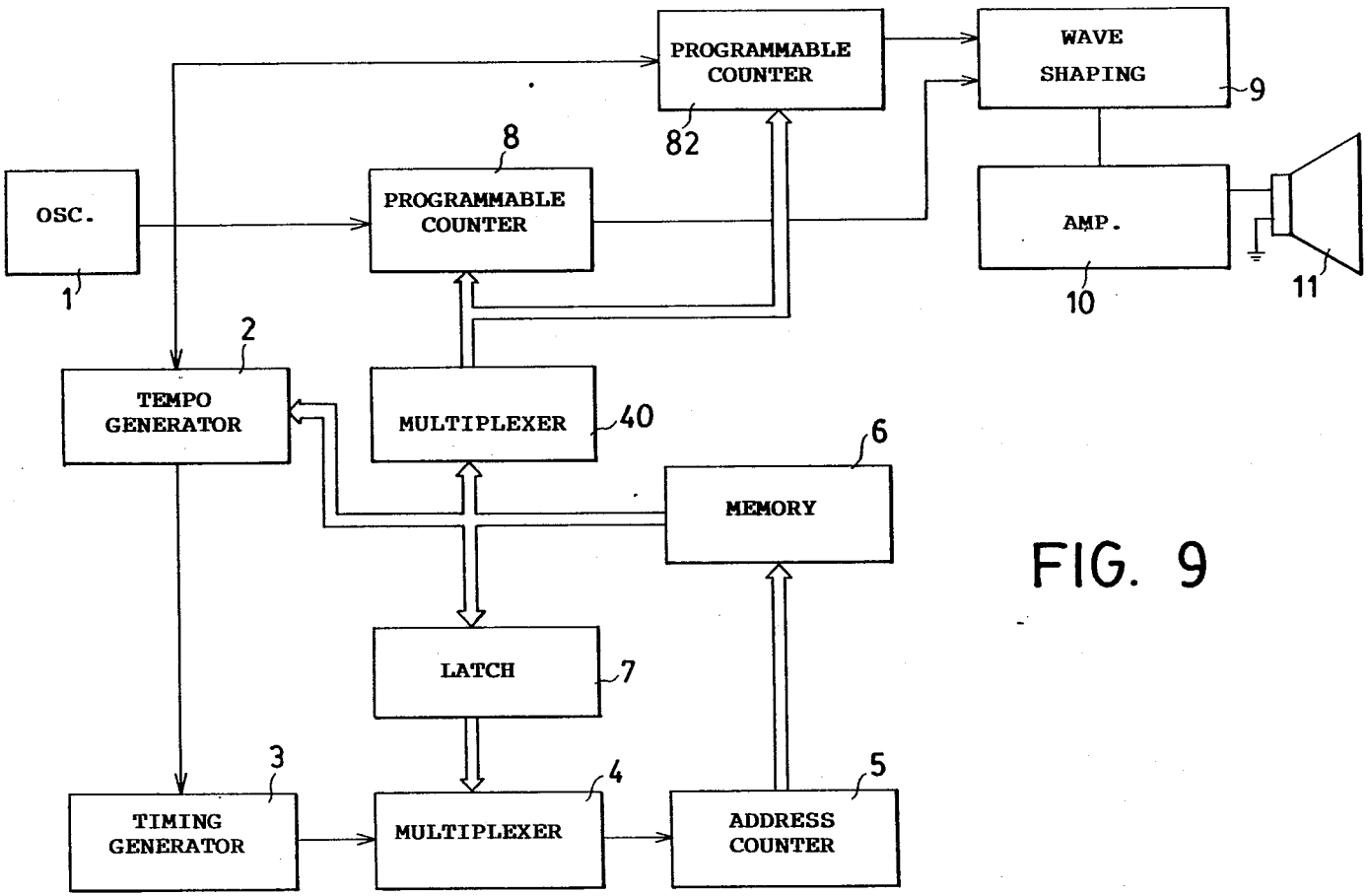
FIG. 9 is a functional block diagram of another embodiment of a dual tone music generator in accordance with the present invention.

Referring now to FIG. 9, another embodiment of this invention further comprises a second programmable counter 82 electrically connected to the wave shaping circuit 9, and a second multiplexer 40 electrically connected to the memory unit 6, to generate a music comprising a main melody and an accompaniment melody. The time data comprises main time data for the main melody and accompaniment time data for the accompaniment melody. The tone data comprises main tone data for the main melody and accompaniment tone data for the accompaniment melody. The main time and accompaniment time data are sent to the latch 7, the main tone data and accompaniment tone data are sent to the second multiplexer 40 which recognizes that the tone data are the main tone data or the accompaniment time data.

The memory unit 6 sends corresponding main tone data to the second multiplexer 40 when receiving the address signal as a result of corresponding main time data passing through the latch 7 and applied to the first multiplexer 4. The memory sends corresponding accompaniment tone data to the second multiplexer 40 when receiving the address signal as a result of corresponding accompaniment time data passing through the latch 7 and applied to the first multiplexer 4. The second multiplexer 40 sends the main tone data to the first programmable counter 8 and sends the accompaniment tone data to the second programmable counter 82, in which the main tone data and accompaniment tone data sent to the first and second programmable counters 8 and 82 are converted into the waveforms by the wave shaping circuit 9 to produce music with dual tones.

Further referring to FIG. 10, the data stored in the memory unit 6 are listed, wherein the tempo data are accompanied by main time data and accompaniment time data of an appropriate range. The main tone data and accompaniment tone data within the range are interleaved with each other behind the time data.

Figure 11:
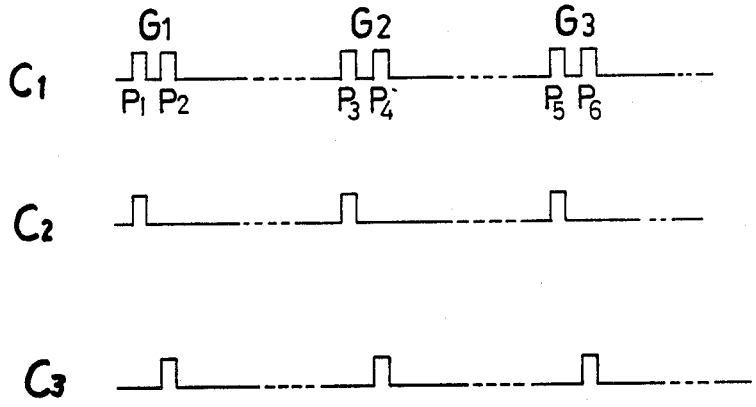
FIG. 11 is a schematic diagram illustrating the clock signals sent from the timing generator to the second multiplexer of the music generator for dual tones of FIG. 9.

Actuated by the tempo generator 2, the timing generator 3 sends clock signals to the first multiplexer 4. As shown in FIG. 11, the clock signals C1 are periodical groups of pulses G1, G2, G3 . . . etc., each group comprising two successive pulses respectively corresponding to the main time data (C2) and the accompaniment time data (C3). For example, group G1 comprises pulses p1 and p2, group G2 comprises pulses p3, p4, and group G3 comprises pulses p5 and p6, in which pulses p1, p3 and p5 correspond to the main time data, and pulses p2, p4 and p6 correspond to the accompaniment time data. It should be noted that the duration between the two pulses of each group is much shorter than that between the adjacent groups. Therefore, the time gap between the p1 and p2 (and also between p3 and p4, between p5 and p6) is negligible and the time for playing the main tone data and accompaniment tone data can be considered to be substantially synchronous. In other words, the insignificant time lag of the accompaniment melody is indiscriminable by human ears.

Figure 1:
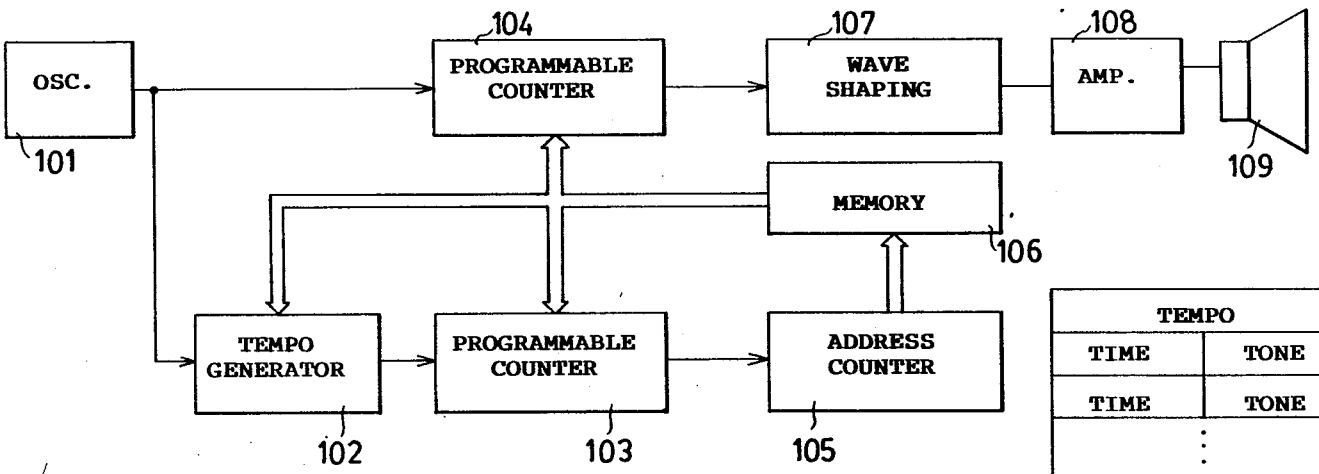
FIG. 1 PRIOR ART
FIG. 1 is a functional block diagram of a conventional music generator having one tone producing circuit.
Figure 2:
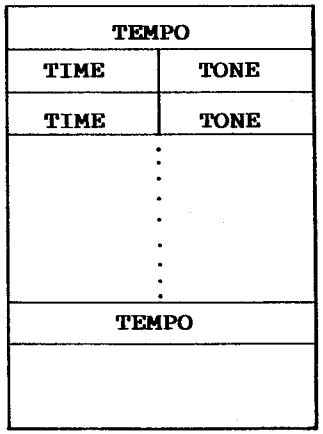
FIG. 2 PRIOR ART
FIG. 2 is a schematic diagram for listing the data stored in the memory unit corresponding to the structure of FIG. 1.
Figure 4:
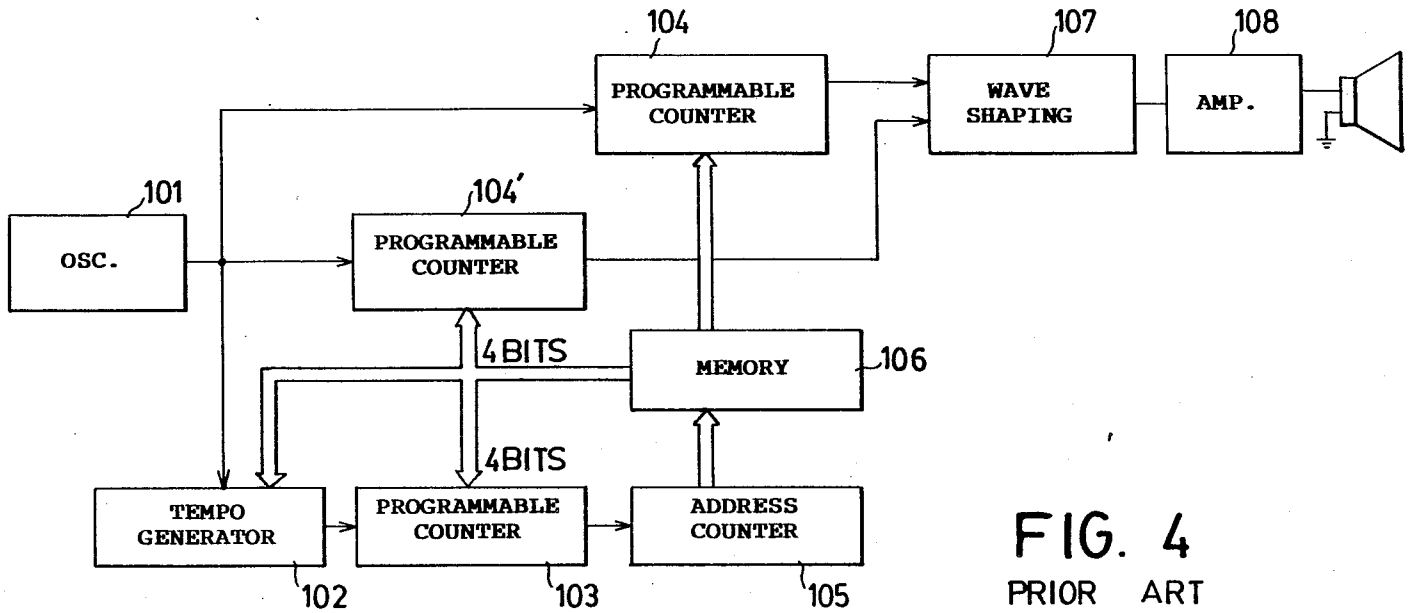
FIG. 4 PRIOR ART
FIG. 4 is a functional block diagram of a conventional dual tone music generator.
Figures 5, 6:
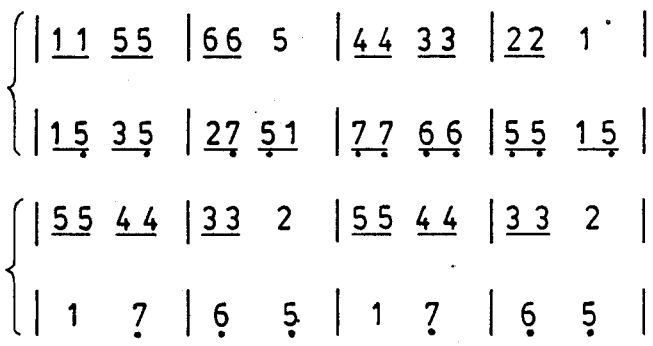
PRIOR ART FIG. 5
FIG. 5 is a schematic diagram for listing the data stored in the memory unit corresponding to the structure of FIG. 4.
FIG. 6 is schematic diagram listing a part of main and accompaniment tones in the selected song.

With respect to the song illustrated in FIG. 6, the note with the shortest time value is an eighth note and the range is one measure. The number of the bits stored in the memory unit is "(8×2+52)×4=272", in which the number of the tones is 52, the number of the ranges is doubled since both the main and accompaniment time are required, and wherein 4 bits are required to store the data.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A music generator for generating a music which consists of at least a main melody, comprising a memory unit storing a plurality of tone data and time data comprising a plurality of bits for said music, an oscillator, a tempo generator enabling said music to be played in a tempo according to a predetermined tempo data stored in said memory unit, a timing generator, at least a first multiplexer, an address counter, a latch, at least a first programmable counter, said oscillator actuating said tempo generator and said first programmable counter, a wave shaping circuit electrically connected to said first programmable counter, an amplifier and a loudspeaker;

said tempo generator being electrically connected to, and actuating said timing generator which sends clock signals to said first multiplexer;

said time data and tone data being read out from said memory unit, said time data being sent to said latch, and said tone data being sent to said first programmable counter;

said latch only selectively allowing a bit of said time data of one state of high and low levels to pass through while stopping a bit of another state thereof, said first multiplexer being responsive to said bit passing through said latch to give a signal to said address counter which in turn gives an address signal to said memory unit to give said tone data to said first programmable counter; and said tone data sent to said first programmable counter being converted into a waveform by said wave shaping circuit and being amplified by said amplifier.

2. A music generator as set forth in claim 1, wherein said music further comprises an accompaniment melody, said music generator further comprises a second programmable counter electrically connected to said wave shaping circuit, and a second multiplexer electrically connected to said memory unit;

said time data comprising main time data for said main melody and accompaniment time data for said accompaniment melody, said tone data comprising main tone data for said main melody and accompaniment tone data for said accompaniment melody, said main time and accompaniment time data being sent to said latch, said main tone data and accompaniment tone data being sent to said second multiplexer;

said memory unit sending corresponding main tone data to said second multiplexer when receiving said address signal as a result of corresponding main time data passing through said latch and applied to said first multiplexer, said memory unit sending corresponding accompaniment tone data to said second multiplexer when receiving said address signal as a result of corresponding accompaniment time data passing through said latch and applied to said first multiplexer;

said second multiplexer sending said main tone data to said first programmable counter and sending said accompaniment tone data to said second programmable counter.

3. A music generator as set forth in claim 2, wherein said clock signals are periodical groups of pulses, each group comprises two successive pulses respectively corresponding to said main time data and said accompaniment data.

* * * * *